US007460102B2

(12) United States Patent
Lee

(10) Patent No.: US 7,460,102 B2
(45) Date of Patent: Dec. 2, 2008

(54) CONTROL MODULE AND METHOD FOR CONTROLLING BACKLIGHT MODULE OF LCD

(75) Inventor: I-Shu Lee, Taoyuan (TW)

(73) Assignee: Au Optronics Corporation, Hsinchu (TW)

( * ) Notice: Subject to any disclaimer, the term of this patent is extended or adjusted under 35 U.S.C. 154(b) by 605 days.

(21) Appl. No.: 10/907,651

(22) Filed: Apr. 11, 2005

(65) Prior Publication Data

US 2006/0087486 A1 Apr. 27, 2006

(30) Foreign Application Priority Data

Oct. 21, 2004 (TW) ..... 93131939 A

(51) Int. Cl.
*G09G 3/36* (2006.01)

(52) U.S. Cl. ..... 345/102; 345/89; 345/204; 315/291

(58) Field of Classification Search ..... 345/102, 345/89, 204; 315/291
See application file for complete search history.

(56) References Cited

U.S. PATENT DOCUMENTS 7,002,306 B2 * 2/2006 Cull et al. ..... 315/291
2004/0017348 A1 * 1/2004 Numao ..... 345/92

* cited by examiner

*Primary Examiner*—Richard Hjerpe
*Assistant Examiner*—Leonid Shapiro
(74) *Attorney, Agent, or Firm*—Jianq Chyun IP Office

(57) ABSTRACT

A liquid crystal display having a display module, a back light module, a programmable voltage generator and a driving circuit is provided. The driving circuit is coupled to the programmable voltage generator and the back light module for adjusting the brightness level of the light sources inside the back light module according to a plurality of driving voltage signals generated by the programmable voltage generator. In addition, the present invention also includes a timing control circuit coupled to the display module so that the display module can output image data. The timing control circuit can detect the illumination status of every one of the light sources inside the back light module and control the programmable voltage generator to provide corresponding driving voltage signals using the illumination status from various light sources.

19 Claims, 7 Drawing Sheets

CONTROL MODULE AND METHOD FOR CONTROLLING BACKLIGHT MODULE OF LCD

CROSS-REFERENCE TO RELATED APPLICATION

This application claims the priority benefit of Taiwan application serial no. 93131939, filed on Oct. 21, 2004.

BACKGROUND OF THE INVENTION

1. Field of the Invention

The present invention relates to a control module for a back light module and controlling method thereof. More particularly, the present invention relates to a control module and a control method that provides a compensating procedure when one or some of the light sources inside a back light module does not illuminate properly and hence the picture on the display device can be stabilized.

2. Description of the Related Art

Liquid crystal display (LCD) has been applied to electronic calculators and electronic clocks in the early 1970s. Thereafter, with the discovery of a few new photoelectric effects and the improvement in the driving methods, LCD has many advantages including a low power consumption, a compact body, a low driving voltage and so on. Hence, LCD has now been widely used in televisions, mobile phones and notebook computers.

In general, liquid crystal display can be categorized into transparent type, transflective type and reflective type. Both the transparent type and the transflective type of liquid crystal device need a back light module to serve as a light source for providing the necessary illumination. To display an image on the transparent or the transflective LCD, the light source inside the back light module generates a beam of light that passes through the back light panel to provide a uniform emission. After passing through the liquid crystal molecules, the light is twisted before emerging as an image on the liquid crystal display panel. Thus, controlling the light source inside the back light module to produce a light beam with a uniform brightness is an important factor in the fabrication of LCD. At present, the most commonly used light source inside a back light module is a back light panel including the cold cathode fluorescent lamp (CCFL) and the light-emitting diode array.

FIG. 1 is a schematic cross-sectional view of a conventional transparent liquid crystal display. As shown in FIG. 1, the transparent liquid crystal display comprises a back light module 100, a display panel 120 and an optical film 122. The back light module 100 shown in FIG. 1 is called a direct-down back light module. The back light module 100 further comprises a lamp box 102 and a diffusion plate 104. The lamp box 102 has a reflective surface 11 and a light outputting surface 13. Inside the lamp box 102, there is a plurality of cold cathode fluorescent lamps 106 laid in parallel to each other to serve as the light sources for the liquid crystal display. Each cold cathode fluorescent lamp 106 serves as a linear light source. When the light from the cold cathode fluorescent lamp 106 gets reflected by the reflective surface 11 to emerge from the light outputting surface 13, a surface light source is formed. To even out the brightness of the surface light source, a diffusion plate 104 is inserted between the optical film 122 and the lamp box 102 so that the light emitting from the lamp box 102 can spread out evenly into each and every area of the display panel 120.

FIG. 2 is a block diagram showing the structural components of a conventional back light module and a driving circuit. As shown in FIG. 2, the back light module 200 has a plurality of cold cathode fluorescent lamps (CCFL) L1~Ln. The driving circuit 210 mainly comprises a connector 212 and a plurality of driving integrated circuits (IC) D1~Dn. The connector 212 is coupled to a fixed voltage source Vin and the driving integrated circuits D1~Dn. In addition, each one of the driving integrated circuits D1~Dn is coupled to a corresponding cold cathode fluorescent lamp. Hence, the driving integrated circuits D1~Dn can receive from the voltage source Vin via the connector 212 a driving voltage for lighting up the cold cathode fluorescent lamps.

One major drawback of the driving technique of a conventional back light module is that there is a drop in the uniformity of the output image displayed through the display panel when one of the cold cathode fluorescent lamps stops producing any light. Consequently, the image display quality of the entire back light module is affected.

SUMMARY OF THE INVENTION

Accordingly, at least one objective of the present invention is to provide a control module for a back light module that can detect and control the illumination status of each light source inside the back light module.

At least a second objective of the present invention is to provide a liquid crystal display that can maintain a definite level of display quality even if one of the light sources inside its back light module suddenly stop producing any light.

At least a third objective of the present invention is to provide a method of controlling a back light module that includes providing a compensating mechanism when one of the light sources within the back light module suddenly stops producing any light.

To achieve these and other advantages and in accordance with the purpose of the invention, as embodied and broadly described herein, the invention provides a control module suitable for controlling a plurality of light sources inside a back light module. The control module of the present invention comprises a programmable voltage generator and driving circuit. The driving circuit is coupled to the programmable voltage generator for adjusting the brightness level of the light sources inside the back light module according to a plurality of driving voltage signals generated by the programmable voltage generator. In addition, the present invention also includes a detect/compensate unit coupled to the programmable voltage generator and the driving circuit for detecting the illumination status of each light source. Thereafter, the illumination status of each light source controls the programmable voltage generator to produce a set of suitable driving voltage signals.

In one embodiment of the present invention, the driving circuit further comprises a plurality of driving integrated circuits coupled to corresponding light sources inside the lighting module. Each driving integrated circuit is coupled to a connector and a coupled light source so that voltage signals submitted by the programmable voltage generator can be received to drive the coupled light sources.

Under a preferred condition, the light sources inside the back light module are cold cathode fluorescent lamps.

From another perspective, the present invention also provides a liquid crystal display comprising a display module, a back light module, a programmable voltage generator and a driving circuit. The driving circuit is coupled to the programmable voltage generator and the back light module so that a plurality of driving voltage signals generated by the programmable voltage generator can be used for driving corresponding light sources inside the back light module. In addition, the present invention also includes a timing control circuit coupled to the display module. It should be noted that the timing control circuit could be used to detect the illumination status of each light source through the driving circuit and control the programmable voltage generator to set the amplitude of the driving voltage signals according to the illumination status of each light source.

Furthermore, the liquid crystal display of the present invention also includes a gray scale generator circuit coupled to the timing control circuit. The timing control circuit controls the output value from the gray scale generator circuit to the display module according to the illumination status of each light source.

In the embodiment of the present invention, the timing control circuit further comprises a data/scan control circuit and detect/compensate unit. The data/scan control circuit transmits a scan signal and a video data to the display module for controlling the output image. The detect/compensate unit is coupled to the data/scan control circuit for detecting the illumination status of each light source via the driving circuits. Furthermore, the timing control circuit further comprises an interface processing circuit coupled to the detect/compensate unit and the programmable voltage generator. Through the interface processing circuit, the detect/compensate unit controls the programmable voltage generator to set the amplitude of the driving voltage signals according to the illumination status of each light source.

The present invention also provides a method of controlling a back light module. The back light module has n light sources, where n is a positive integer. The controlling method of the present invention includes the following steps. First, the back light module is activated and then the illumination status of each light source is detected. If the $m^{th}$ light source does not illuminate and the value of m is neither 1 nor n, then the brightness of the $(m+1)^{th}$ and the $(m-1)^{th}$ light source are increased, where m is a positive integer. If the first light source does not illuminate, then the brightness of the second light source is increased. On the other hand, if the nth light source does not illuminate, then the brightness of the $(n-1)^{th}$ light source is increased.

In addition, the method further includes checking the $(m+1)^{th}$ and the $(m-1)^{th}$ light source responsible gray scale data of the display area when the $m^{th}$ light source does not illuminate. When the $(m+1)^{th}$ and the $(m-1)^{th}$ light source responsible gray scale data value of the display area is greater than a preset value, then the last two bits of the $(m+1)^{th}$ and the $(m-1)^{th}$ light source responsible gray scale data are set to zero.

Similarly, the method further includes checking the 2nd light source responsible gray scale data of the display area when the first light source does not illuminate. When the 2nd light source responsible gray scale data value of the display area is greater than a preset value, then the last two bits of 2 nd light source responsible gray scale data are set to zero.

Under the same token, the method further includes checking the $(n-1)^{th}$ light source responsible gray scale data of the display area when the nth light source does not illuminate. When the $(n-1)^{th}$ light source responsible gray scale data value of the display area is greater than a preset value, then the last two bits of $(n-1)^{th}$ light source responsible gray scale data are set to zero.

In brief, the present invention utilizes a programmable voltage generator to produce driving voltage signals for the driving integrated circuits so that the driving integrated circuits can light up the light sources according to corresponding driving voltage signals. Therefore, the control module provided by the present invention can provide individual control of the illumination status of each light source. When one of the light sources cannot light up for whatever reason, the present invention also provides a compensation mechanism for increasing the brightness of neighboring light sources and controlling the gray scale data inside the corresponding display area. Thus, the liquid crystal display of the present invention is able to maintain a definite quality in the displayed image even if the back light module inside the liquid crystal display cannot function normally.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
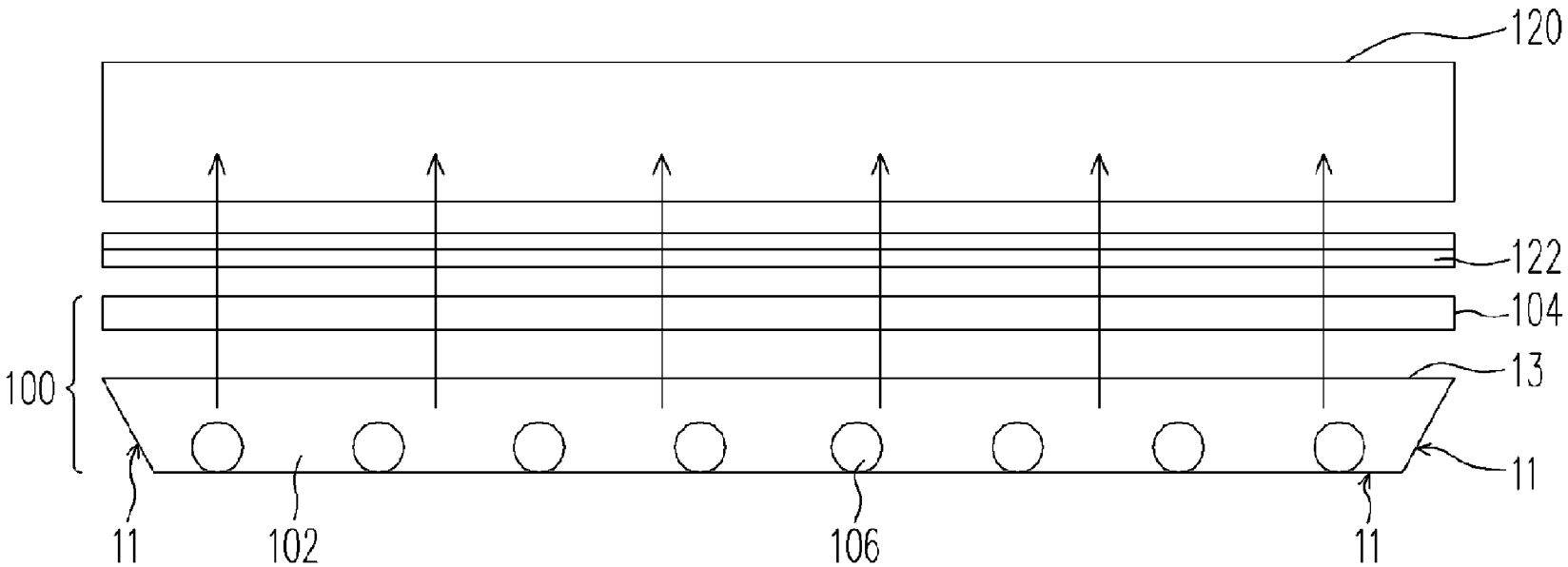
FIG. 1 (PRIOR ART)
FIG. 1 is a schematic cross-sectional view of a conventional transparent liquid crystal display.
Figure 2:
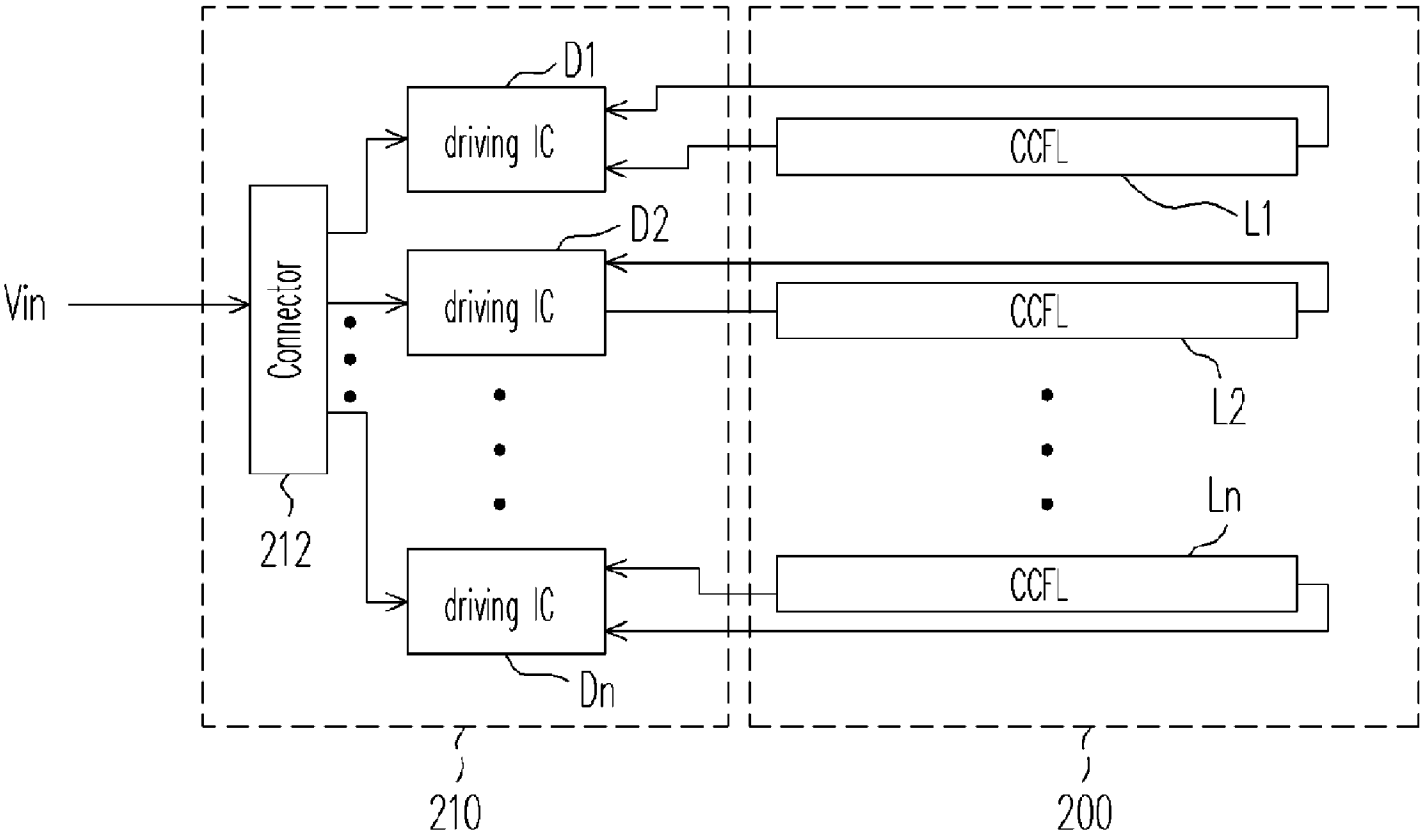
FIG. 2 (PRIOR ART)
FIG. 2 is a block diagram showing the structural components of a conventional back light module and a driving circuit.

Reference will now be made in detail to the present preferred embodiments of the invention, examples of which are illustrated in the accompanying drawings. Wherever possible, the same reference numbers are used in the drawings and the description to refer to the same or like parts.

Figure 3:
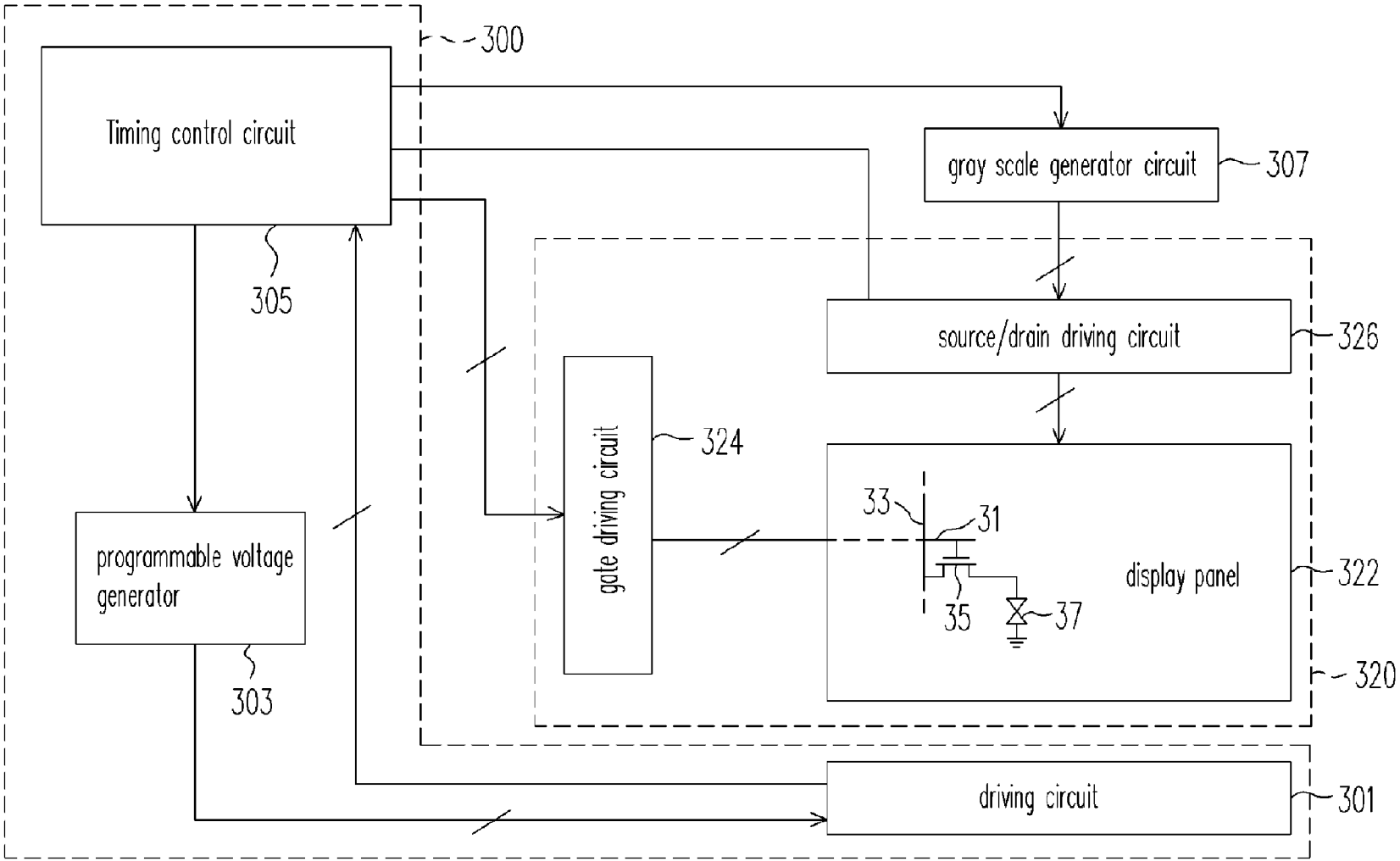
FIG. 3 is a block diagram showing the internal components of a liquid crystal display according to one preferred embodiment of the present invention.

FIG. 3 is a block diagram showing the internal components of a liquid crystal display according to one preferred embodiment of the present invention. As shown in FIG. 3, the liquid crystal display of the present invention comprises a control module 300 and a display module 320. Inside the control module 300, there is a driving circuit 301 coupled to a programmable voltage generator 303 for driving the back light module to emit light according to the output provided by the programmable voltage generator 303. Thus, the light necessary for illuminating the display module 320 is provided. Although the location of the back light module is not shown in FIG. 3, anyone familiar with the technique may notice that the back light module should be disposed under the display module 320. When the back light module is in operation, a timing control circuit 305 will detect the illumination status of the back light module through the driving circuit 301. Thereafter, according to the illumination status of the back light module, the timing control circuit 305 controls the programmable voltage generator 303 to produce a suitable set of driving voltage signals for adjusting the status of the light sources inside the back light module.

The liquid crystal display shown in FIG. 3 may further comprise a gray scale generator circuit 307 for generating gray scale data and submitting the data to the display module 320. When the timing control circuit 305 detects the operating states of the back light module through the driving circuit 301, the timing control circuit 305 will also controls the gray scale generator circuit 307 to adjust the weight of the submitted gray scale data.

The display module 320 further comprises a display panel 322, a gate driving circuit 324 and a source/drain driving circuit 326. The display panel 322 has a plurality of scan lines 31 laid down in parallel in a first direction and coupled to the gate driving circuit 324. Furthermore, a plurality of data lines 33 is also laid down in parallel in a second direction on the display panel 322 and coupled to the source/drain driving circuit 326, wherein the first direction is perpendicular to the second direction. A thin film transistor 35 is disposed at the intersection between each scan line 31 and data line 33. The gate terminal of each thin film transistor 35 is coupled to the scan line 31, the first source/drain terminal is coupled to the data line 33 and the second source/drain terminal is coupled to a pixel electrode 37. Furthermore, the gate driving circuit 324 and the source/drain driving circuit 326 are coupled to the timing control circuit 305. The timing control circuit 305 will control the gate driving circuit 324 to output a scan signal to one of the scan lines 31 so that all the thin film transistors 35 along the same scan line are enabled. Thereafter, the timing control circuit 305 will transmit video data to the source/drain driving circuit 326 so that the video data is submitted to one of the enabled thin film transistors 35 through one of the data lines 33 to light up a coupled pixel electrode 37. Because the structure and operating principles of the display panel 322 has been discussed in various prior patents and the design of the display panel 322 is not a principle concern in the present invention, a detail description of the display panel 322 is omitted.

Figure 4:
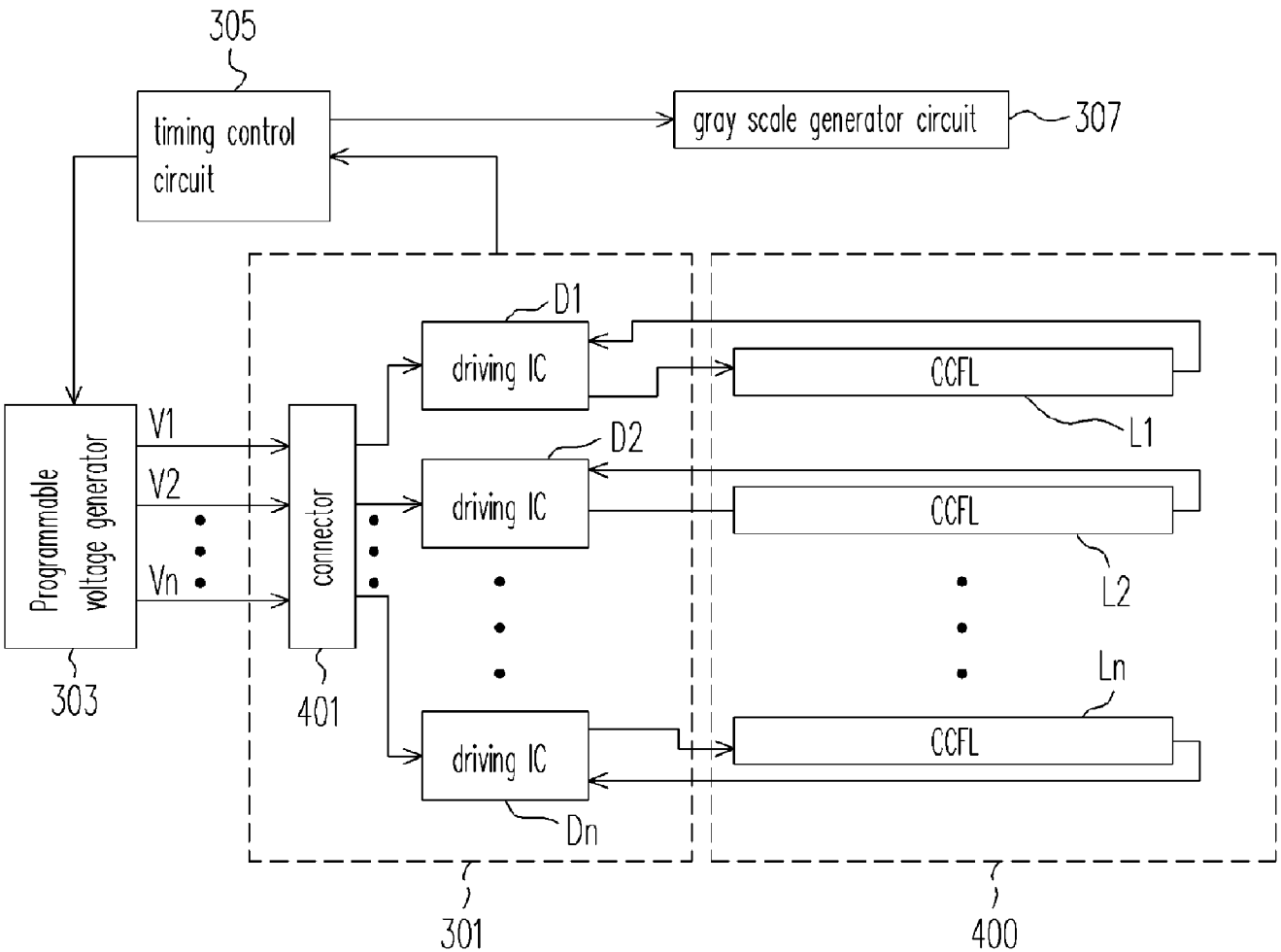
FIG. 4 is a block diagram showing the components of a control module and a back light module according to one preferred embodiment of the present invention.

FIG. 4 is a block diagram showing the components of a control module and a back light module according to one preferred embodiment of the present invention. As shown in FIG. 4, the back light module 400 can be used inside the liquid crystal display shown in FIG. 3. The back light module 400 has n light sources (L1~Ln), where n is a positive integer. In the following description, n is the total number of light sources. In addition, the light sources are preferably cold cathode fluorescent lamps (CCFL).

The driving circuit 301 shown in FIG. 4 may comprise the same number of driving integrated circuits (IC) (D1~Dn) as the number of light sources. Each driving integrated circuit is connected to a corresponding light source. In addition, the driving circuit 301 may include a connector 401 coupled to the programmable voltage generator 303 for receiving a plurality of driving voltage signals V1~Vn from the programmable voltage generator 303. The connector 410 is also coupled to all the driving integrated circuits D1~Dn. Hence, the driving voltage signals V1~Vn generated by the programmable voltage generator 303 can be transmitted to a corresponding driving integrated circuit through the connector 401. It should be noted that the timing control circuit 305 could detect the illumination status of every one of the light sources L1~Ln through each driving integrated circuit D1~Dn. Therefore, the timing control circuit 305 can control the programmable voltage generator 303 and the gray scale generator circuit 307 according to the illumination status of each of the light sources L1~Ln.

Figure 5:
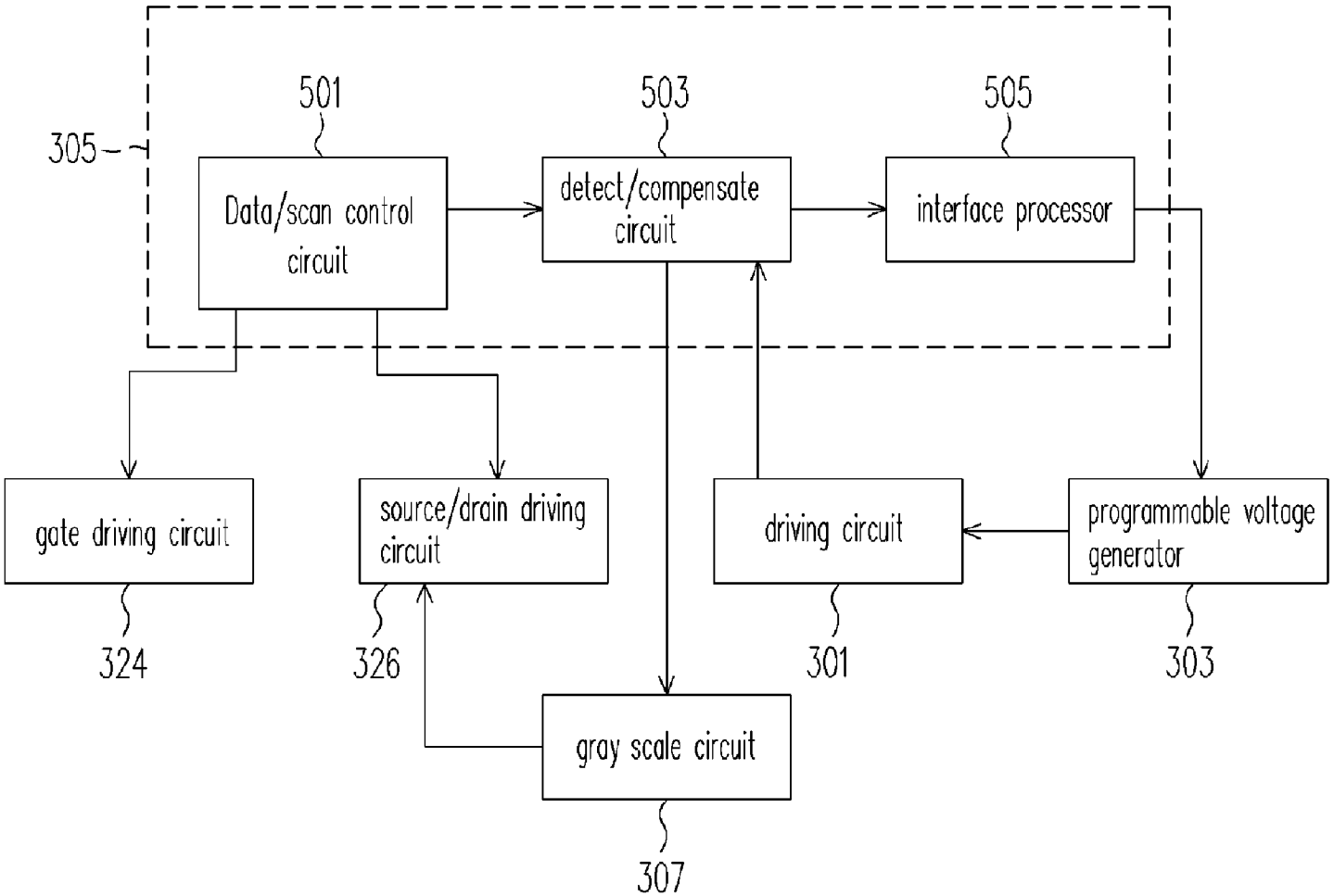
FIG. 5 is a block diagram showing the internal components of a detect/compensate circuit according to one preferred embodiment of the present invention.

FIG. 5 is a block diagram showing the internal components of a detect/compensate circuit according to one preferred embodiment of the present invention. The timing control circuit 305 in FIG. 5 further comprises a data/scan control circuit 501 and a detect/compensate circuit 503. The data/scan control circuit 501 is coupled to the gate driving circuit 324 and the source/drain driving circuit 326 for transmitting scan signals and video data to the gate driving circuit 324 and the source/drain driving circuit 326 respectively. Hence, an image is output on the display module 320 as shown in FIG. 3. The detect/compensate circuit 503 is coupled to the data/scan control circuit 501. When the data/scan control circuit 501 outputs scan signals and a video data, the detect/compensate circuit 503 will detect the illumination status of each of the light sources L1~Ln as shown in FIG. 4 through the driving circuit 301. Thereafter, according to the illumination status of each of the light sources L1~Ln, the detect/compensate circuit 503 controls the output gray scale data of the gray scale generator circuit 307. Through the interface processing circuit 505, the detect/compensate circuit 503 also controls the transmission of the driving voltage signals from the programmable voltage generator 303 to the driving circuit 301.

Figure 6:
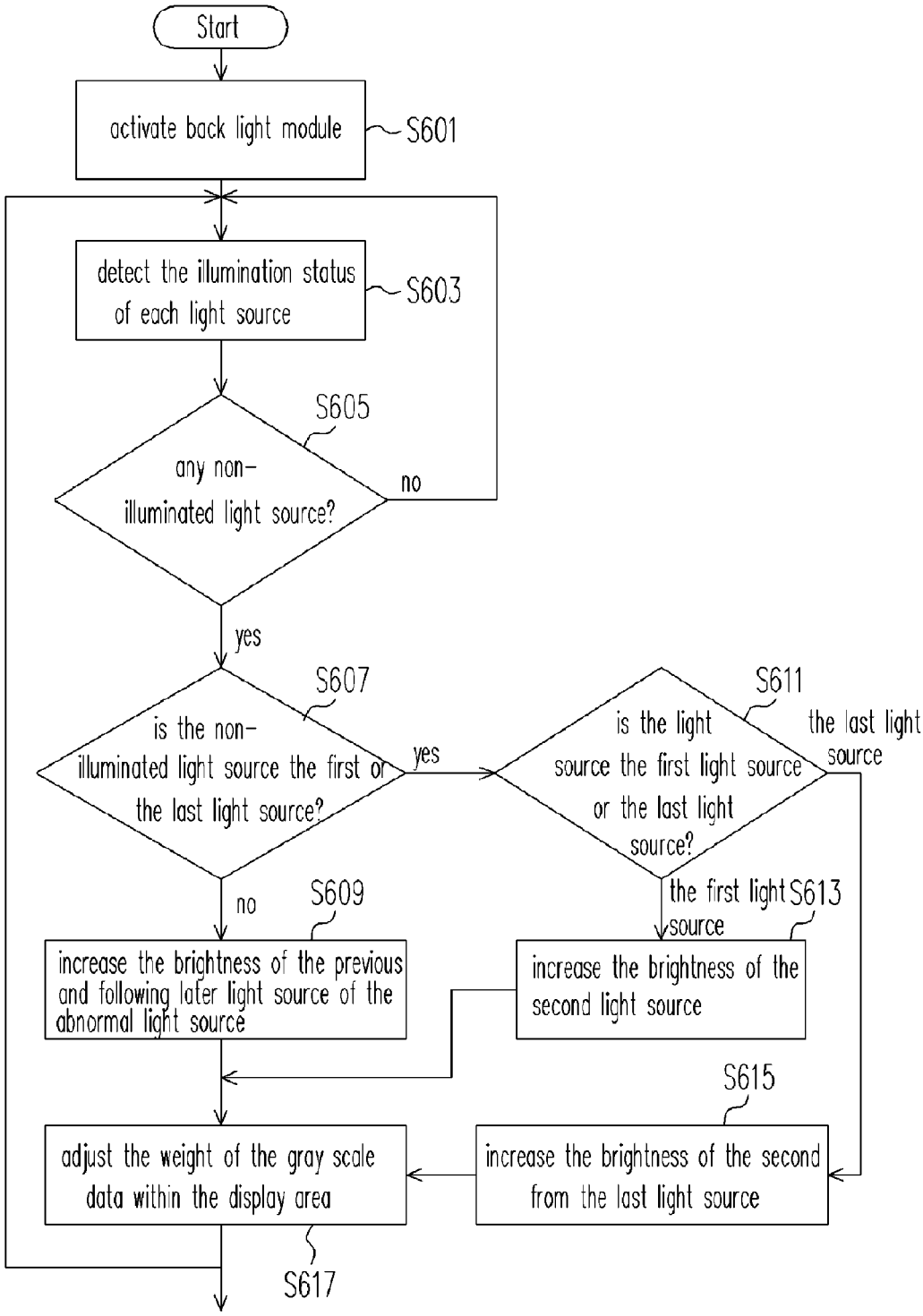
FIG. 6 is a flow diagram showing the steps for controlling a back light module according to one preferred embodiment of the present invention.

FIG. 6 is a flow diagram showing the steps for controlling a back light module according to one preferred embodiment of the present invention. As shown in FIGS. 4 and 6, the back light module 400 is activated in step S601. Once the back light module 400 is activated, each of driving integrated circuits D1~Dn will drive their corresponding light sources to produce light according to their received driving voltage signals. Thereafter, the timing control circuit 305 will detect the illumination status of each light source through the driving circuit 301 in step S603 and then determine if there is any non-illuminated light source in step S605. When the timing control circuit 305 finds out that the illumination status of all the light sources is normal (the result of the inquiry in step S605 is a 'no'), the step S603 is repeated. On the other hand, if a non-illuminated light source is discovered (the result of the inquiry in step S605 is a 'yes'), then the step S607 is carried out to determine if the anomalous one is a first or a last light source. If the timing control circuit 305 finds out that the $m^{th}$ light source (Lm) cannot be illuminated and m is not equal to 1 or n, the timing control circuit 305 controls the programmable voltage generator 303 to increase the $(m+1)^{th}$ and the $(m-1)^{th}$ driving voltage signals (Vm+1 and Vm−1). Hence, the $(m+1)^{th}$ and the $(m-1)^{th}$ driving integrated circuit (Dm+1 and Dm−1) will increase the brightness of the $(m+1)^{th}$ and the $(m-1)^{th}$ light source (Lm+1 and Lm−1) in step S609.

However, if the light source that cannot be illuminated is the first or the last light source (the result of the inquiry is 'no' in step S607), the step S611 is carried out to determine if the non-illuminated light source is the first light source or the last light source. If the timing control circuit 305 finds out that the first light source L1 does not illuminate, then the timing control circuit 305 controls the programmable voltage generator 303 to increase the second voltage signal V2. Hence, the 2 nd driving integrated circuit D2 will increase the brightness of the second light source L2 in step S613. On the other hand, if the last light source does not illuminate, the timing control circuit 305 controls the programmable voltage generator 303 to increase the second last voltage signal Vn−1. Hence, the second last driving integrated circuit Dn−1 will increase the brightness of the second last light source Ln−1 in step S615.

When the brightness level of the light source is increased, the brightness of the display area corresponding to a light source is also enhanced. Thus, to maintain a uniform display image after adjusting the brightness level of the light sources, the timing control circuit 305 will also direct the gray scale generator 307 to adjust the weight of the gray scale data in the display area in step S617. Consequently, the entire picture is more homogeneous.

In another selected embodiment, the control method in the present invention permits a user to initiate the activation. For example, the user may press a particular key to activate the control method in the present invention. If the control method can be user-triggered, the user may decide to repeat the step S603 after finding all light sources are normal in step S605 or after the execution of step S617.

Figure 7:
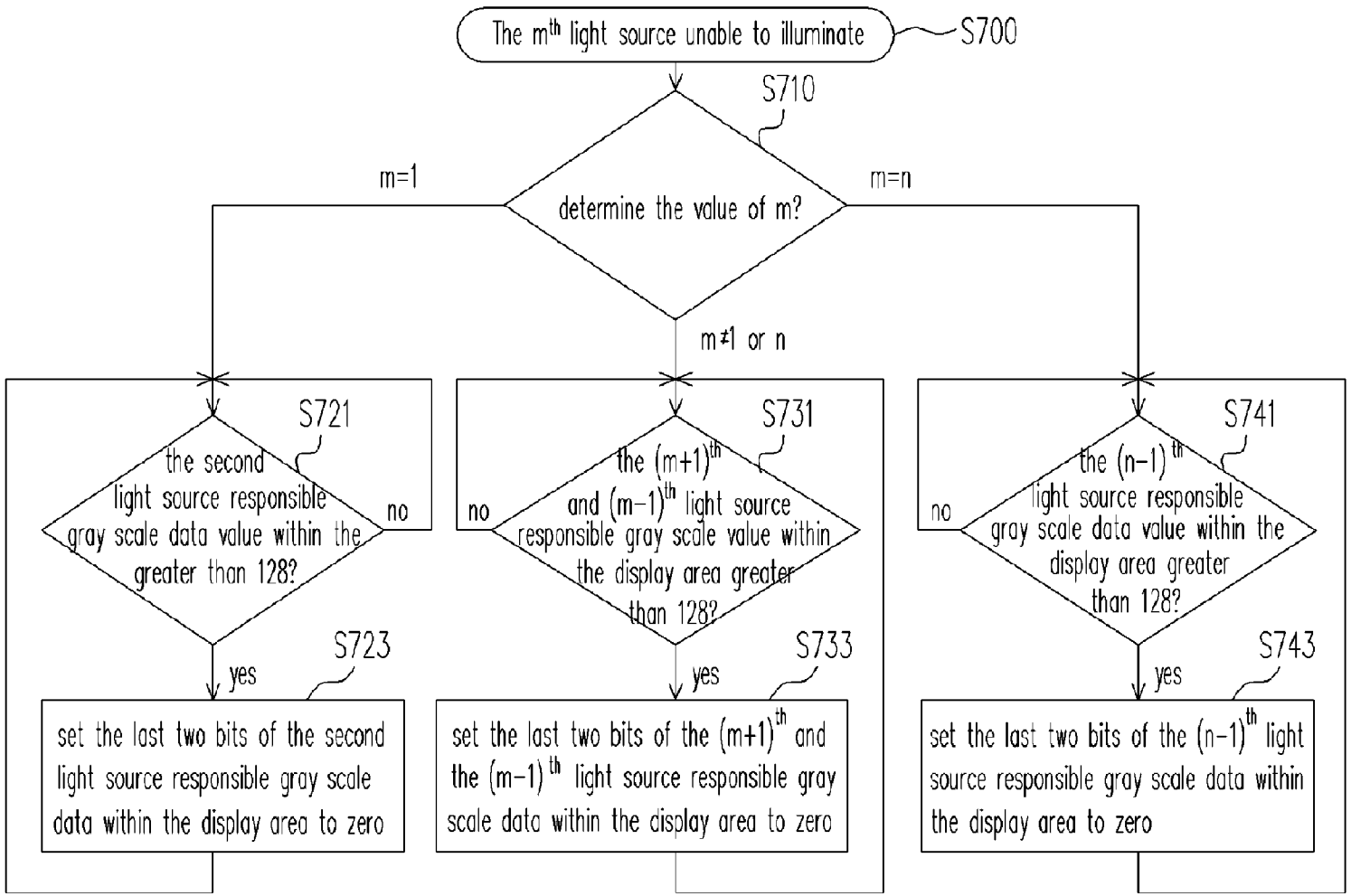
FIG. 7 is a flow diagram showing the steps for adjusting gray scale data according to one preferred embodiment of the present invention.

FIG. 7 is a flow diagram showing the steps for adjusting gray scale data according to one preferred embodiment of the present invention. The method of the present embodiment can be applied to the step S617 in FIG. 6. As shown in FIGS. 4 and 7, if the timing control circuit 305 finds out that the $m^{th}$ light source Lm cannot be illuminated in step S700, then the step S710 is carried out to determined the value of m. If the value of m is 1 (that is, m=1), then the timing control circuit 305 will check to determine if the second light source L2 responsible gray scale data value within the display area is greater than a preset value in step S721. In the present embodiment, the preset value is 128. If the light source L2 responsible gray scale data value within the display area does not exceed 128 (the result of the inquiry in step S721 is a 'no'), then the step S721 is repeated. However, if the light source L2 responsible gray scale data value within the display area exceeds 128 (the inquiry in step S721 is a 'yes'), then the timing control circuit 305 controls the gray scale generator 307 to set the two last bits of the light source L2 responsible gray scale data within the display area to zero.

If the value of m is neither a 1 nor an n, then the timing control circuit 305 will check if the $(m-1)^{th}$ light source Lm−1 and the $(m+1)^{th}$ light source Lm+1 responsible light gray scale data value within the display area is greater than 128 or not in step S731. The timing control circuit 305 will check to determine if the $(m-1)^{th}$ light source Lm−1 and the $(m+1)^{th}$ light source Lm+1 responsible light gray scale data value does not exceed 128 (the result of the inquiry in step S731 is a 'no'), the step S731 is repeated. However, if the $(m-1)^{th}$ light source Lm−1 and the $(m+1)^{th}$ light source Lm+1 responsible gray scale data value within the display area exceeds 128 (the inquiry in step S731 is a 'yes'), the timing control circuit 305 controls the gray scale generator 307 to set the two last bits of the $(m-1)^{th}$ light source Lm−1 and the $(m+1)^{th}$ light source Lm+1 responsible gray scale data within the display area to zero.

If the value of m is n (that is, m=n), then the timing control circuit 305 will check to determine if the $(n-1)^{th}$ light source Ln−1 responsible gray scale data value within the display area is greater than a preset value in step S741. If the light source Ln−1 responsible gray scale data value within the display area does not exceed 128 (the result of the inquiry in step S741 is a 'no'), then the step S741 is repeated. However, if the light source Ln−1 responsible gray scale data value within the display area exceeds 128 (the inquiry in step S741 is a 'yes'), the timing control circuit 305 controls the gray scale generator 307 to set the two last bits of the light source Ln−1 responsible gray scale data within the display area to zero.

Although the aforementioned description is centered upon a single non-illuminated light source, the present invention can be applied to deal with situations when more than one non-illuminated light sources are present. Anyone familiar with the technique may notice that the present invention can be used to process a back light module having a portion of the light sources not lighting up.

In summary, major advantages of the present invention includes as follows.

1. The control module in the present invention utilizes a programmable voltage generator to produce driving voltage signals for lighting up the light sources. Therefore, after setting the programmable voltage generator, the brightness of any one or a portion of the light sources can be adjusted according to the actual requirements.

2. Under the conditions that one or a portion of the light sources into the back light module cannot be lighted, the brightness level of neighboring normal light sources can be increased. Thus, the liquid crystal display of the present invention is able to maintain a definite display quality in the image.

3. Aside from adjusting the brightness of the light sources, the gray scale value of a corresponding display area is also adjusted. Thus, the display image can have a high degree of homogeneity even if a single or a portion of the light sources within the back light module would not light up.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A control module for controlling a back light module having n light sources, where n is a positive integer and greater than 2, the control module comprising:

a programmable voltage generator for producing a plurality of driving voltage signals;

a driving circuit coupled to the programmable voltage generator for respectively and correspondingly driving the light sources according to the driving voltage signals; and a detect/compensate unit coupled to the programmable voltage generator and the driving circuit for respectively detecting the illumination status of each light source and accordingly controlling the programmable voltage generator to produce the driving voltage signals having an appropriate amplitude for respectively driving the light sources, wherein when the detect/compensate unit detects the $m^{th}$ light source cannot be illuminated, the detect/compensate unit controls the programmable voltage generator to increase the brightness of the $(m+1)^{th}$ and the $(m-1)^{th}$ light source, and adjusts the weight of the $(m+1)^{th}$ and the $(m-1)^{th}$ light source responsible gray scale data within the display area, wherein m is neither 1 nor n.

2. The control module of claim 1, wherein the driving circuit comprises:

a connector coupled to the programmable voltage generator; and a plurality of driving integrated circuits coupled to the connector and respectively corresponding to the light sources for respectively receiving the driving voltage signals to drive the light sources.

3. The control module of claim 1, wherein the light sources comprise cold cathode fluorescent lamps.

4. The control module of claim 1, further comprising an interface processing circuit coupled to the detect/compensate unit and the programmable voltage generator.

5. A liquid crystal display, comprising:

a display module;

a back light module having n light sources, where n is a positive integer and greater than 2;

a programmable voltage generator for producing a plurality of driving voltage signals;

a driving circuit coupled to the programmable voltage generator and the back light module for respectively and correspondingly driving the light sources according to the driving voltage signals; and a timing control circuit coupled to the display module for respectively detecting the illumination status of each light source and accordingly controlling the programmable voltage generator to produce the driving voltage signals having an appropriate amplitude for respectively driving the light sources, wherein when the timing control circuit detects the $m^{th}$ light source cannot be illuminated, the timing control circuit controls the programmable voltage generator to increase the brightness of the $(m+1)^{th}$ and the $(m-1)^{th}$ light source, and adjusts the weight of the $(m+1)^{th}$ and the $(m-1)^{th}$ light source responsible gray scale data within the display area, wherein m is neither 1 nor n.

6. The liquid crystal display of claim 5, further comprising a gray scale generator circuit such that the timing control circuit controls an output gray scale data from the gray scale generator circuit to the display module according to the illumination status of each light source.

7. The liquid crystal display of claim 5, wherein the display module comprises:

a display panel having a plurality of data lines laid down in parallel to each other and a plurality of scan lines laid down in parallel to each other, wherein:

the data lines are aligned in a direction perpendicular to the scan lines;

a thin film transistor is disposed at the intersection between each data line and scan line;

a gate terminal of each thin film transistor is coupled to a corresponding scan line;

a first source/drain terminal of each thin film transistor is coupled to a corresponding data line; and a second source/drain terminal, of each thin film transistor is coupled to a pixel electrode;

a gate driving circuit coupled to the timing control circuit and the scan lines for enabling the thin film transistor on one of the scan lines according to the scan signals output from the timing control circuit; and a source/drain driving circuit coupled to the timing control circuit and the data lines for sending a video data to a data line on one of the enabled thin film transistor according to the control signal output from the timing control circuit.

8. The liquid crystal display of claim 6, wherein the timing control circuit comprises:

a data/scan control circuit for transmitting a scan signal and a video data to the display module so that an image is output on the display module;

a detect/compensate unit coupled to the data/scan control circuit for detecting the illumination status of each light source and controlling the output gray scale data from the gray scale generator circuit; and an interface processing circuit coupled to the detect/compensate unit and the programmable voltage generator, wherein the detect/compensate unit controls the programmable voltage generator through the interface processing circuit to set the amplitude of corresponding driving voltage signals.

9. The liquid crystal display of claim 5, wherein the driving circuit comprises:

a connector coupled to the programmable voltage generator; and a plurality of driving integrated circuits coupled to the connector and respectively corresponding to the light sources for respectively receiving the driving voltage signals to drive the light sources.

10. The liquid crystal display of claim 5, wherein the light sources comprise cold cathode fluorescent lamps.

11. A method of controlling a back light module having n light sources, where n is a positive integer and greater than 2, the controlling method comprising:

activating the back light module;

detecting the illumination status of each light source;

increasing the brightness of the $(m+1)^{th}$ and the $(m-1)^{th}$ light source when the $m^{th}$ light source is found to be non-illuminated and m is neither 1 nor n, where m is a positive integer;

increasing the brightness of the second light source when the first light source is found to be non-illuminated; and increasing the brightness of the $(n-1)^{th}$ light source when the nth light source is found to be non-illuminated;

wherein the weight of the $(m+1)^{th}$ and the $(m-1)^{th}$ light source responsible gray scale data within the display area is adjusted when the $m^{th}$ light source cannot be illuminated.

12. The control method of claim 11, wherein the step for adjusting the weight of the gray scale data comprises:

checking the $(m+1)^{th}$ and the $(m-1)^{th}$ light source responsible gray scale data within the display area, and setting the last two bits of the $(m+1)^{th}$ and the $(m-1)^{th}$ light source responsible gray scale data within the display area to zero when the $(m+1)^{th}$ and the $(m-1)^{th}$ light source responsible gray scale data within the display area is greater than a preset value.

13. The control method of claim 11, wherein the weight of the second light source responsible gray scale data within the display area is adjusted when the first light source cannot be illuminated.

14. The control method of claim 13, wherein the step for adjusting the weight of the gray scale data comprises:

checking the second light source responsible gray scale data within the display area, and setting the last two bits of the second light source responsible gray scale data within the display area to zero when the second light source responsible gray scale data within the display area is greater than a preset value.

15. The control method of claim 11, wherein the weight of the $(n-1)^{th}$ light source responsible gray scale data within the display area is adjusted when the nth light source cannot be illuminated.

16. The control method of claim 15, wherein the step for adjusting the weight of the gray scale data comprises:

checking the $(n-1)^{th}$ light source responsible gray scale data within the display area, and setting the last two bits of the $(n-1)^{th}$ light source responsible gray scale data within the display area to zero when the $(n-1)^{th}$ light source responsible gray scale data within the display area is greater than a preset value.

17. The control method of claim 11, wherein the step of detecting the illumination status of each light source is repeated when the illumination status of light sources is normal.

18. The control method of claim 11, when the illumination status of all light sources is found to be normal, further comprising the steps of:

determining if the status of the back light module need to be checked again; and repeating the detection. of the illumination status of each light source when it has been decided that the status of the back light module need to be checked again.

19. The control method of claim 11, wherein the light sources comprise cold cathode fluorescent lamps.

* * * * *